United States Patent [19]

Fujita

[11] Patent Number: 4,464,549

[45] Date of Patent: Aug. 7, 1984

[54] DIGITAL SWITCH

[75] Inventor: Teizo Fujita, Ibaraki, Japan

[73] Assignee: Idec Izumi Corporation, Osaka, Japan

[21] Appl. No.: 440,698

[22] Filed: Nov. 10, 1982

[51] Int. Cl.[3] ..... H01H 21/76

[52] U.S. Cl. ..... 200/42 R; 200/11 TW; 200/156; 200/321; 200/328; 200/334

[58] Field of Search ..... 200/42 R, 11 TW, 11 R, 200/328, 331, 338, 321, 331, 334, 156, 318

[56] References Cited

U.S. PATENT DOCUMENTS

| | | | |
|---|---|---|---|
| 1,445,847 | 2/1923 | Platt | 200/42 R |
| 3,809,830 | 5/1974 | Lockard et al. | 200/11 TW |
| 4,112,278 | 9/1978 | Greiner et al. | 200/11 TW X |
| 4,190,749 | 2/1980 | Erickson et al. | 200/11 TW |
| 4,257,283 | 3/1981 | Haller et al. | 200/156 X |
| 4,369,342 | 1/1983 | Suzuki | 200/328 X |

FOREIGN PATENT DOCUMENTS

| | | | |
|---|---|---|---|
| 658413 | 2/1963 | Canada | 200/334 |

*Primary Examiner*—John W. Shepperd
*Assistant Examiner*—Renee S. Kidorf
*Attorney, Agent, or Firm*—Pollock, Vande Sande & Priddy

[57] ABSTRACT

Disclosed is a digital switch which is manually rotated step by step and which comprises a casing, a wheel rotatably supported in the casing, device for manually rotating the wheel step by step, an electrical contact carried by the wheel, an electrical circuit board attached to the casing and provided with a plurality of electrical contacts which are successively touched by the electrical contact carried by the wheel when the wheel is rotated step by step, for producing an electrical signal in accordance with a stepping rotary position of the wheel, and a locking device for disabling the wheel rotating device.

17 Claims, 13 Drawing Figures

DIGITAL SWITCH

BACKGROUND OF THE INVENTION

1. Field of the Invention

This invention relates to a digital switch. A digital switch may be defined as a switch which may be used in a single fashion or in a ganged fashion with other digital switches and which is provided with a switch mechanism for changing over external electrical circuits in response to the stepping rotation of a switch wheel and a display mechanism for providing a digital display in accordance with the rotary position of the switch wheel. The digital switch is a kind of rotary switch and so-called as a thumb-wheel switch, thumb-rotary switch, etc. (hereinafter merely referred to as a digital switch).

2. Description of the Prior Art

In a conventional digital switch, the switch setting has been made by manually rotating a numeral mark displaying wheel with a finger step by step at a part of the wheel projecting out of the casing or by rotating the wheel by pushing down a wheel actuating rod also projecting out of the casing. Accordingly, there has been a drawback that the setting of switch might be gone over by carelessly touching the wheel or the actuating rod. There has been a further drawback that numbers of different kinds of digital switches have to be produced and stocked by the kind of display of the wheel for each of the dust-proof type and the non-dustproof type in the case where the digital switches of both such types.

SUMMARY OF THE INVENTION

It is an object of the present invention to eliminate the drawbacks in the conventional digital switches as mentioned above.

It is another object of the present invention to provide a digital switch which is provided with a switching-setting-lock mechanism for locking a switch setting wheel actuating rod.

It is a further object of the present invention to provide a digital switch in which a previously commonly prepared housing unit and a selected one of previously prepared various wheels different in number of the stepping of the wheel are assembled.

It is a still further object of the present invention to provide a digital switch in which a previously commonly prepared housing unit and a selected one of previously prepared wheels of the dust-proof type and non-dustproof type are assembled.

BRIEF DESCRIPTION OF THE DRAWINGS

The foregoing and other objects of the present invention and the aspects of the same will become apparent from the following detailed description of preferred embodiments of the invention when considered in conjunction with the accompanying drawings, in which:

FIG. 6A showing one surface of the wheel provided with a stepping gear wheel, FIG. 6B showing the other surface of the same provided with an electrical contact;

DESCRIPTION OF PREFERRED AND OTHER EMBODIMENTS

Figure 1:
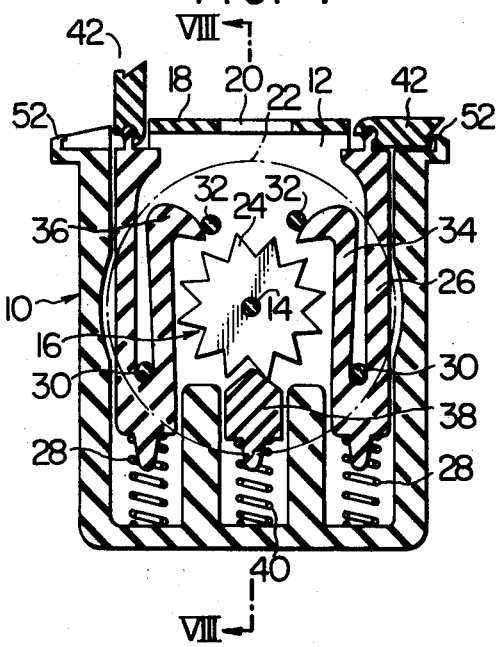
FIG. 1 is a longitudinal sectional view of a digital switch according to an embodiment of the present invention.
Figure 2:
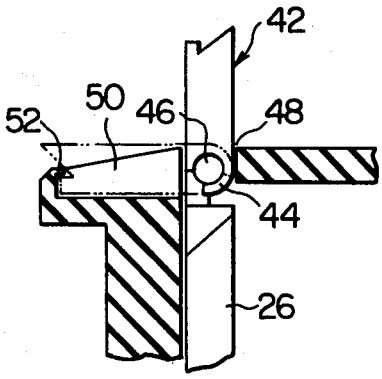
FIG. 2 is a partial sectional view of the FIG. 1 embodiment for particularly explaining a switch-setting-lock mechanism.

A preferred embodiment of the present invention will be described by referring to FIGS. 1, 2, 3, 6A, 6B, and 8. In the drawing, a casing 10 contains therein a switch setting wheel 16 which is pivotally supported on a post 14 integrally provided and projecting from a side wall 12 of the casing 10 such that numerical or other marks provided on the circumferential peripheral surface 22 of the wheel 16 may be successively appear at a window 20 formed in an upper wall 18 of the casing 10. The wheel 16 is provided at its one side surface with an electrical contact 21 which may successively contact with a plurality of electrical contacts 25 provided on a printed circuit board 23 as the wheel 16 is rotated, so that an electrical signal is produced corresponding to the numerical or other mark appearing at the window 20. The wheel 16 is longitudinally provided with a gear wheel portion 24 which may be rotated step by step by one of a pair of switch-setting-wheel actuating members 26 described later. The actuating members 26 are upwardly biased respectively correspondingly by a pair of springs 28. The upward movement of the actuating members 26 is limited by a pair of stopper pins 30 integrally provided on the side wall 12 of the casing 10. Each of the actuating members 26 has a branch 34 integrally provided therewith. The branches 34 respectively have finger portions 36 which are transversely outwardly biased by a pair of urging pins 32 at the position at which the upward movement of the actuating members 26 is limited by the stopper pins 30, so that the inner front end of each of the finger portions 36 comes out of a circular path of the respective teeth tips of the gear wheel portion 24. In this arrangement, when a selected one of the actuating members 26 is pushed down, the finger portion 36 of the branch 34 of the same engages an opposite one of the teeth of the gear wheel portion 24 and pushes down the engaged tooth so as to rotate by one step the gear wheel portion 24, and therefore the switch setting wheel, without being interfered by the finger portion 36 of the branch 34 of the other actuating member 26 which is urged away out of the circular path as mentioned above. An upward force applying member 38 normally pushes a bottom portion of adjacent teeth of the gear portion 24 so as to place the gear wheel portion 24 in its stabilized position. When the gear wheel portion 24 is caused to begin to rotate, the upward force applying member 38 comes out of the bottom portion so far engaged and goes over one of the adjacent teeth of the bottom portion. When the member 38 has passed over the tip of the tooth, it pushes upward the opposite side of the tooth so as to rotate the gear wheel portion 24 until the member 38 has engaged the next bottom portion of the teeth. In this manner, a one-pitch stepping operation has been completed. A pair of pushing-down members 42 are respectively provided at opposite upper end portions of the casing 10. The pushing-down members 42 are normally brought down in their locked position in respective recesses 50, while a selected one of them may be erected to be manually pushed down by finger for pushing down a corresponding one of the actuating members 26 against the spring 28 thereof. Each of the pushing-down members 42 has at its lower end a C-shaped hook portion 44 which is pivotally engaged with a bar portion 46 integrally provided at the upper end of the associated actuating member 26 through a connecting portion 45 and projected into a window 48 continuously formed with the recess 50. It is preferable to provide a small projection 52 at the side wall of each recess 50 so that the free end of the pushing-member 42 may be engaged with the projection 52 and prevented from being erected carelessly or freely.

Figure 3:
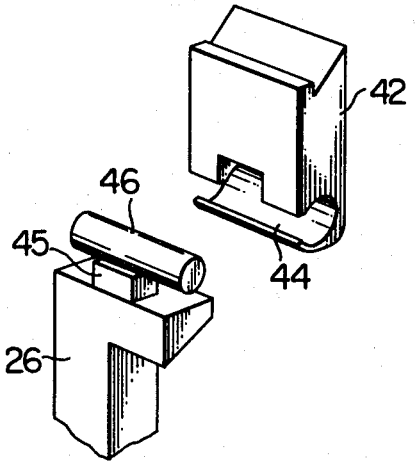
FIG. 3 is a partial perspective view of a switch-setting-wheel actuating member and a pushing member for explaining the engagement therebetween.
Figure 4:
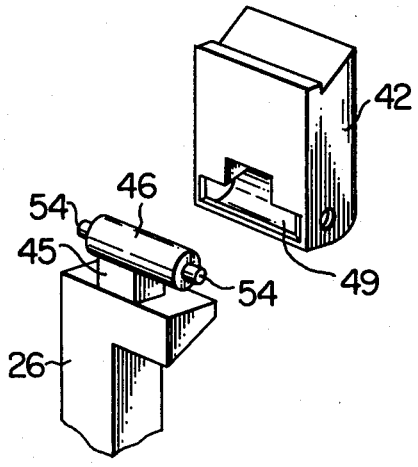
FIG. 4 is a partial perspective view illustrating a modification of the FIG. 3 embodiment.

FIG. 4 shows a modification of the mechanism shown in FIG. 3, in which the pushing-down member 42 has a box-like shape and engages the bar portion 46 in such a manner that a pair of projections 54 integrally formed at opposite ends of the bar portion 46 are respectively inserted into a pair of holes 47 provided at opposite side walls of a recess 49 for accommodating the bar portion 46 therein at the lower end portion of the box-like pushing-down member 42.

Figure 5:
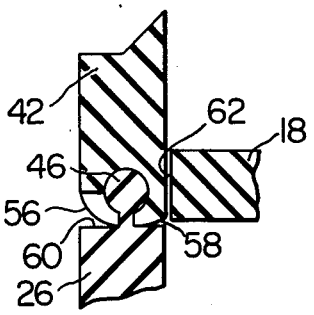
FIG. 5 is a partial sectional view illustrating a further modification of the FIG. 3 embodiment.
Figure 6A:
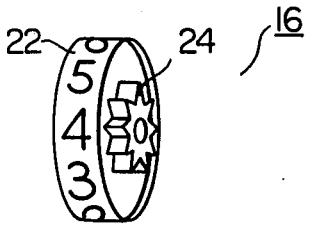
FIGS. 6A and 6B are perspective views illustrating an example of a switch setting wheel.
Figure 6B:
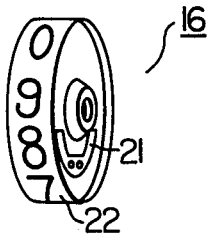

FIG. 5 shows a modification of the FIG. 4 embodiment, in which the opposite lower corners 56 and 58 of the box-like pushing-down member 42 are rounded with different radii, the outer one being large and the inner one being small, so that when the pushing-down member 42 is in its erected state, it is prevented from being freely brought down owing to the force produced between the side wall 62 of the window 48 and the surface of the inner corner 58 of the pushing-down member 42, while there is produced no force between the upper end portion of the actuating member 26 and the inner corner 56 of the member 42, and when the member 42 is resting in its locked brought-down position, it is prevented from being freely erected for the same reason as above. In this manner, a switch-setting-locking mechanism is provided according to the present invention. In this case, a selected one of the pushing-down members 42 may be manually erected from its brought-down position against the force produced between the side wall 62 and the inner corner 58 owing to the flexibility of the connecting portion 45 of the associated actuating member 26, and vice versa. It is not necessary in this case, therefore, to provide the protrusion 52 of the previous embodiment.

In the embodiment as mentioned above, since the pushing-down member 42 is brought down into the recess 50 to rest thereat in its normal state and erected when it is necessary to push down the actuating member, it is possible to avoid mis- or mal-operation of the pushing-down member due to careless touch, especially such a mal-operation that the pushing-down member of any digital switch adjacent to the very one whose wheel has to be rotated is carelessly pushed in the case where a plurality of digital switches are used in a ganged fashion.

Figure 7:
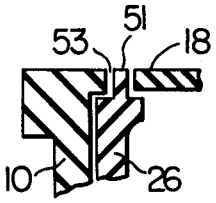
FIG. 7 is a partial sectional view illustrating another embodiment of the switch-setting-lock mechanism.
Figure 8:
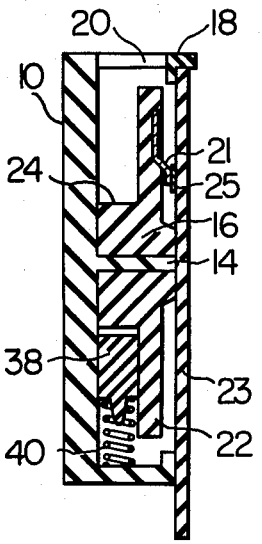
FIG. 8 is a longitudinal sectional view of an embodiment of the digital switch provided with a switch setting wheel of the non-dustproof type.

FIG. 7 shows another embodiment of the switch-setting-lock mechanism. In this embodiment, the pushing-down member 42 of the above-mentioned embodiment is omitted and the actuating member 26 is integrally provided with a protrusion 51 in place of the connecting portion 45 and the bar portion 46. The protrusion 51 is inserted into a hole 53 formed in the upper wall 18 of the casing 10 in place of the recess 50 and the window 48, such that it does not project from the upper end of the casing 10 even when the actuating member 26 is not pushed down. Thus, the actuating member can not be pushed down by a careless mal-operation, while it is easily pushed down by using a tip of a fine rod such as a ball-point pen or pencil. It will be appreciated that the arrangement of this embodiment is of course included in the switch-setting-lock mechanism according to the present invention.

In the embodiments as mentioned above, there is a further advantage that an arbitrary one of wheels different from each other in number of stepping operation thereof may be accommodated in a commonly prepared housing unit if those wheels have been prepared such that they are the same in the dimension thereof and in the diameter of a circular path along which the tip end of each of the respective teeth of the gear wheel 24 rotates. For example, three kinds of wheels of decimal stepping, duodenary stepping and sexadecimal stepping, may be employed for the same housing units which have been prepared commonly for those wheels, so as to produce various kinds of digital switches of different stepping number. This is attained by not only the upward force applying member 38 but the pair of pins 32 which are provided for normally outwardly biasing the respective finger portions 36 so that the finger portions 36 can not engage the teeth of the gear wheel portion when they are not pushed down.

Figure 9:
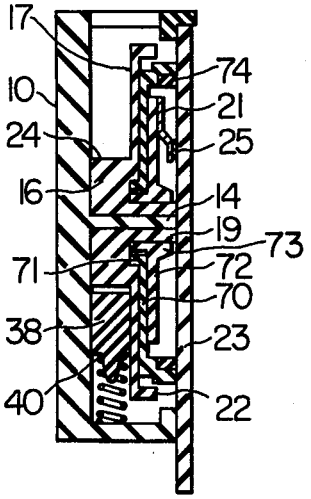
FIG. 9 is a longitudinal sectional view of an embodiment of the digital switch provided with a switch setting wheel of the dust-proof type.

By referring to FIG. 9, next, an embodiment of the digital switch of the dust-proof type will be described, instead of the digital switch of the non-dustproof type illustratd in the previous embodiments. In FIG. 9, similarly to FIG. 8, the actuating members, pushing down members, etc. have been omitted merely for the sake of simplicity of the drawing.

In FIG. 9, a wheel 16 of the dust-proof type includes a first cup-like wheel member 17, a second cup-like wheel member 70, and a third wheel member 72. The first wheel member 17 has a central cylindrical portion 19 into which the post 14 of the casing 10 is inserted so as to rotatably support the first wheel member 17, a circumferential peripheral portion 22 on which a display of numerical or other marks is provided, and a gear wheel portion 24 provided on its one side surface. The second wheel member 70 has its one side surface opposed to and made slidably face-to-face contact with the other side surface of the first wheel member 17, a central annular projecting portion 71 inserted into a central annular groove of the first wheel member 17, and a circumferential peripheral portion. A suitable ring packing 74 is provided between the circumferential peripheral portion of the second wheel member 70 and a side surface of the printed circuit board 23 so as to make airtight the inside of the cup-like space portion defined by the other side surface and circumferential peripheral portion of the second wheel member 70 and the printed circuit board 23. The second wheel member 70 is fixedly attached to the printed circuit board 23 by means of, for example, a plurality of protrusions (not shown) formed at the free edge of the circumferential peripheral portion and inserted into holes correspondingly formed in the side surface of the printed circuit board 23, so as to prevent the second wheel member from rotating when the first wheel member 17 is rotated. The third wheel member 72 has a central hollow cylindrical portion 73 into which the central cylindrical portion 19 of the first wheel member 17 is fixedly inserted so that the third wheel member 72 may be rotated with the first wheel member 17, one side surface opposed to and made slidably face-to-face contact with the other side surface of the second wheel member 70, and the other side surface on which an electrical contact 21 is provided such that the contact 21 may be made in electrical contact with a selected one of a plurality of electrical contacts 25 provided on the side surface of the printed circuit board 23.

In the thus arranged embodiment according to the invention, there are advantages that the assembling work of the digital switch is very simple because the three dust-proof type wheel members may be assemblied one by one from one side of the casing to provide a digital switch of the dust-proof type, and that no dust can enter the airtight space in which the electrical contacts are accommodated owing to the unique arrangement of the wheel assembly of the dust-proof type, so that the good performance of the digital switch can be maintained for a long time.

Further, in the embodiment according to the present invention, since the wheel assembly of the dust-proof type can be made same in dimension as the non-dustproof wheel (FIG. 8), there is a further advantage that a selected one of the dust-proof type digital switch and the non-dustproof type digital switch can be desiredly produced by incorporating a selected one of the dustproof type wheel assembly and the non-dustproof type wheel into a commonly prepared housing unit in use.

Figure 10:
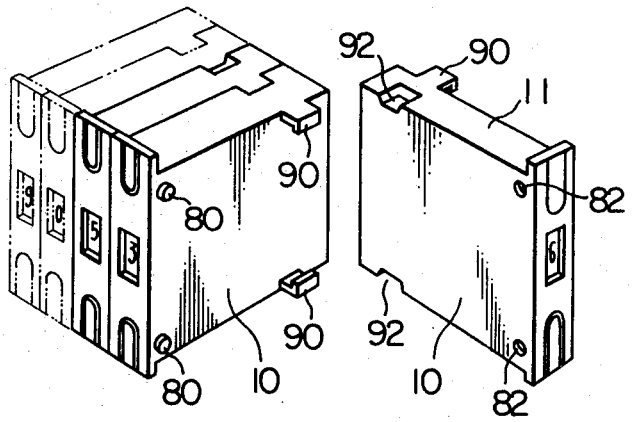
FIG. 10 is a perspective view showing a plurality of the digital switches according to the present invention connected with each other by conventional engagement means.

FIG. 10 shows a plurality of digital switches according to the invention coupled into a ganged fashion by conventional connecting means. In FIG. 10, A casing 10 of each digital switch is provided with a pair of protrusions 80 and a pair of engaging fingers 90 at front end portions and at back end portions in its one side surface respectively and a pair of recesses 82 and a pair of engaging recesses 92 at the respective portions corresponding to the protrusions 80 and the engaging fingers 90 in its other side surface, so that the protrusions 80 and the engaging fingers 90 of the casing 10 of one digital switch are inserted into the corresponding recesses 82 and engaging recesses 92 of the casing 10 of another digital switch as seen in FIG. 10. In this manner, a desired number of digital switches can be coupled one after one without using any connecting means such as screws. There is, however, a drawback, when two digital switches are disconnected from their coupled state in this case, that it is necessary to outwardly urge the pair of engaging fingers 90 by using a tool such as a screwdriver so as to make them release from the corresponding engaging recesses 92 with not only inconvenience or troublesome in work but a risk of damage of the engaging fingers 90.

Figure 11:
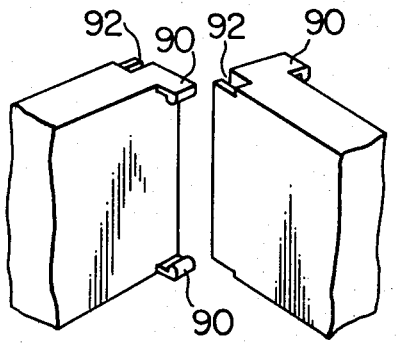
FIGS. 11 and 12 are perspective views illustrating an embodiment of the engagement means according to the present invention for connecting a plurality of digital switches.
Figure 12:
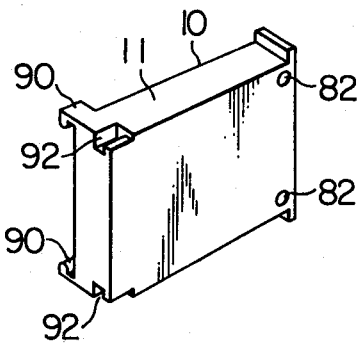

FIGS. 11 and 12 show an improvement in the connecting means of digital switches according to the present invention. In this embodiment, a pair of engaging fingers 90 are provided at back edge portions in the one side surface of the casing of each digital switch such that each of the engaging fingers 90 opens in not only the side end surface 11 but rear end surface 13 so that two coupled digital switches can be easily disconnected merely by displacing any one of the two switches backwardly. In this embodiment, therefore, there is an advantage that coupled digital switches can be disconnected by using no tool without any risk of damage of the engaging fingers and that it is not necessary to make flexible the engaging fingers 90.

I claim:

1. A digital switch comprising:

a casing;

a wheel rotatably supported in said casing, said wheel including a gear wheel portion having a predetermined number of teeth;

means for manually rotating said wheel step by step, said wheel rotating means including a pair of actuating means each supported in said casing and individually movably between an actuated and a non-actuated position;

a pair of bias means respectively biasing an associated one of said pair of actuating means to its non-actuated position;

a pair of pushing-down means provided outside of said casing each respectively pivotally coupled with a corresponding one of said pair of actuating means through a corresponding one of a pair of apertures in a wall portion of said casing so that each of said pushing-down means is manually movable between a non-actuating position and an actuating position in which said corresponding one of said pair of actuating means can be pushed down to said actuated position against said associated one of said pair of bias means, each of said pair of actuating means having a finger means which cannot engage said gear wheel portion when said actuating means is in its non-actuated position but which does engage a specific one of the teeth of said gear wheel portion so as to rotate said gear wheel portion and therefore said wheel by one step in a predetermined rotary direction when said actuating means is brought into its actuated position from its non-actuated position;

an electrical contact carried by said wheel;

electrical circuit means attached to said casing and provided with a plurality of electrical contacts which are successively touched by said electrical contact carried by said wheel when said wheel is rotated step by step for producing an electrical signal in accordance with a stepping rotary position of said wheel; and locking means for disabling said wheel rotating means, said locking means including a pair of engaging means for each of said pair of pushing-down means, one of said pair of engaging means being provided on a wall portion of said casing and the other of said pair of engaging means being provided on said pushing-down means so that said pair of engaging means engage with each other when said pushing-down means is in its non-actuating position so as to disable said pushing-down means by preventing its free movement unless said pushing-down means is manually brought into its actuating position.

2. A digital switch according to claim 1, comprising means for displaying a mark representing a stepping rotary position of said wheel.

3. A digital switch according to claim 1, wherein each of said pair of pushing-down means can be selectively erected into its actuated position with respect to said casing so that it is substantially aligned with a corresponding one of said pair of actuating means, and can be selectively brought down into its non-actuated position so as to be accommodated in a corresponding one of a pair of recesses in said casing; and wherein said pair of engaging means for each of said pushing-down means includes a protrusion on said wall portion of said casing or on a portion of a corresponding one of said pushing-down means and a recess on the other of said portions, said protrusion and said recess being engaged when said pushing-down means is in its non-actuating position.

4. A digital switch according to claim 1 wherein each of said pair of pushing-down means can be selectively erected into its actuated position with respect to said casing so that it is substantially aligned with a corresponding one of said pair of actuating means, and can be brought down into its non-actuated position so as to be accommodated in a corresponding one of a pair of recesses in said casing; and wherein said pair of engaging means for each of said pushing-down means includes a portion of a corresponding one of said pair of pushing-down means and a wall portion of said casing which engage each other to generate a locking force when said corresponding pushing-down means is moved between its actuated and non-actuated positions.

5. A digital switch according to claim 1 wherein each of said pair of actuating means includes a main portion supported movably between an actuated and a non-actuated position; and a flexible branch portion integrally connected to said main portion and having said finger means integrally formed at a free end of said branch portion, said finger means being brought into its non-actuated position, at which said finger means cannot engage said gear wheel portion, by being outwardly biased by a pin positioned on said casing so as to cause flexure of said branch portion when said main portion is in its non-actuated position, and said finger means being brought into its actuated position at which said finger means engages the teeth of said gear wheel portion when said main portion is in its actuated position.

6. A digital switch according to claim 1, wherein said wheel includes a first portion carrying marks representing respective stepping rotary positions thereof at its circumferential periphery and said gear wheel portion is integrally formed on a side surface, of said wheel, and wherein said wheel rotating means includes a pair of actuating members which selectively individually engage with said gear wheel portion so as to rotate said gear wheel portion by a step corresponding to one tooth of said gear wheel portion in opposite directions when said actuating members are actuated respectively.

7. A digital switch according to claim 6, wherein said wheel is one selected from among a plurality of various wheels whose gear portions have teeth different in number from one another.

8. A digital switch according to claim 1, wherein said wheel includes a first cup-like wheel member rotatably supported by a post integrally provided at a portion of said casing, said first wheel member carrying marks representing respective stepping rotary positions thereof at its circumferential peripheral surface and being integrally provided with a gear wheel portion at one side surface, a second cup-like wheel member fixedly and airtightly supported at its circumferential periphery by said electrical circuit means so as to define an airtight space between said second cup-like wheel member and said electrical circuit means and positioned so as to be relatively slidably in face-to-face contact between the other side surface of said first wheel member and one side surface of said second wheel member, and a third wheel member fixedly supported by said first wheel member so as to be rotated with said first wheel member when said first wheel member rotates and positioned so as to be relatively slidably in face-to-face contact between the other side surface of said second wheel member and one side surface of said third wheel member, said third wheel member carrying said electrical contact on the other side surface thereof; and wherein said wheel rotating means includes a pair of actuating members which selectively and individually engage with said gear wheel portion so as to rotate said gear wheel portion by a step corresponding to one tooth of said gear wheel portion in opposite directions when said actuating members are actuated respectively.

9. A digital switch according to claim 8, wherein said first cup-like wheel member is one selected from among a plurality of various first cup-like wheels whose gear portions have teeth different in number from one another.

10. A digital switch according to claim 1, wherein said casing is provided at its one side surface with a pair of protrusions and a pair of engagement fingers at its other side surface with a first pair of recesses corresponding to said pair of protrusions and a second pair of recesses corresponding to said pair of engagement fingers so that said pair of protrusions and said pair of engagement fingers of the casing of said digital switch can be engaged with the corresponding first and second recesses of the casing of another digital switch of the same type when these digital switches are connected in a ganged fashion, said second recesses being formed at opposite corners of said other side surface such that each of said second recesses opens in both two adjacent end surfaces which are perpendicular to each other and to said side surface.

11. A digital switch comprising:

(A) a wheel unit selected from among a plurality of prefabricated wheel units of the dust-proof type and of the non-dustproof type for various stepping operations different in stepping number from one another, each of said prefabricated wheel units carrying an electrical contact and including a gear wheel portion having a predetermined number of teeth;

(B) a prefabricated housing unit including, (a) a casing, (b) means rotatably supporting said selected wheel unit in said casing, (c) wheel rotating means for manually rotating said selected wheel unit step by step, said wheel rotating means including a pair of actuating means each supported in said casing and individually movably between an actuated and a non-actuated position;

(d) a pair of bias means respectively biasing an associated one of said pair of actuating means to its non-actuated position;

(e) a pair of pushing-down means provided outside of said casing each respectively pivotally coupled with a corresponding one of said pair of actuating means through a corresponding one of a pair of apertures in a wall portion of said casing so that each of said pushing-down means is manually movable between a non-actuating position and an actuating position in which said corresponding one of said pair of actuating means can be pushed down to said actuated position against said associated one of said pair of bias means, each of said pair of actuating means having a finger means which cannot engage said gear wheel portion when said actuating means is in its non-actuated position but which does engage a specific one of the teeth of said gear wheel portion so as to rotate said gear wheel portion and therefore said wheel by one step in a predetermined rotary direction when said actuating means is brought into its actuated position from its non-actuated position;

(f) electrical circuit means attached to said casing and provided with a plurality of electrical contacts which are successively toughed by said electrical contact carried by said selected wheel unit when said selected wheel unit is rotated step by step for producing an electrical signal in accordance with a stepping rotary position of said selected wheel unit; and, (g) locking means for disabling said selected wheel unit rotating means, said locking means including a pair of engaging means for each of said pair of pushing-down means, one of said pair of engaging means being provided on a wall portion of said casing and the other of said pair of engaging means being provided on said pushing-down means so that said pair of engaging means engage with each other when said pushing-down means is in its non-actuating position so as to disable said pushing-down means by preventing its free movement unless said pushing-down means is manually brought into its actuating position.

12. A digital switch according to claim 11, wherein said selected wheel unit includes means for displaying a mark representing a stepping rotary position of said selected wheel unit.

13. A digital switch according to claim 11, wherein said wheel unit of dust-proof type includes a first cup-like wheel member rotatably supported by a post integrally provided at a portion of said casing, said first wheel member carrying marks representing respectively stepping rotary positions thereof at its circumferential peripheral surface and being integrally provided with a gear wheel portion at one side surface, a second cup-like wheel member fixedly and airtightly supported at its circumferential periphery by said electrical circuit means so as to define an airtight space between said second cup-like wheel member and said electrical circuit means and positioned so as to be relatively slidably in face-to-face contact between the other side surface of said first wheel member and one side surface of said second wheel member, and a third wheel member fixedly supported by said first wheel member so as to be rotated with said first wheel member when said first wheel member rotates and positioned so as to be relatively slidably in face-to-face contact between the other side surface of said second wheel member and one side surface of said third wheel member, said third wheel member carrying said electrical contact on the other side surface thereof; and wherein said wheel rotating means includes a pair of actuating members which selectively and individually engage with said gear wheel portion so as to rotate said gear wheel portion by a step corresponding to one tooth of said gear wheel portion in opposite directions when said actuating members are actuated respectively.

14. A digital switch according to claim 11 wherein each of said pair of actuating means includes a main portion supported movably between an actuated and a non-actuated position; and a flexible branch portion integrally connected to said main portion and having said finger means integrally formed at a free end of said branch portion, said finger means being brought into its non-actuated position, at which said finger means cannot engage said gear wheel portion, by being outwardly biased by a pin positioned on said casing so as to cause flexure of said branch portion when said main portion is in its non-actuated position, and said finger means being brought into its actuated position at which said finger means engages the teeth of said gear wheel portion when said main portion is in its actuated position.

15. A digital switch according to claim 11, wherein said casing is provided at its one side surface with a pair of protrusions and a pair of engagement fingers and at its other side surface with a first pair of recesses corresponding to said pair of protrusions and a second pair of recesses corresponding to said pair of engagement fingers so that said pair of protrusions and said pair of engagement fingers of the casing of said digital switch can be engaged with the corresponding first and second recesses of the casing of another digital switch of the same type when these digital switches are connected in a ganged fashion, said second recesses being formed at opposite corners of said other side surface such that each of said second recesses opens in both two adjacent end surfaces which are perpendicular to each other and to said side surface.

16. A digital switch comprising:

a casing having a pair of apertures;

a wheel rotatably supported in said casing;

means for manually rotating said wheel step by step, said wheel rotating means including a pair of actuating members supported in said casing and individually movable between an actuated and a non-actuated position, and each of said actuating members having means for engaging said wheel so as to rotate said wheel by one step in a predetermined rotary direction when said actuating member is brought into its actuated position from its non-actuated position;

a pair of pushing members provided outside of said casing each connected to a corresponding one of said pair of actuating members through a corresponding one of said pair of apertures so as to push said corresponding actuating member into its actuated position, each of said pushing members being manually pivotable between a non-actuating position adjacent to said casing and an actuating position erect relative to said casing and movement of said actuating member from its non-actuated position to its actuated position being prevented unless said pushing member is in its erect actuating position;

an electrical contact carried by said wheel;

electrical circuit means mounted within said casing adjacent to said wheel and provided with a plurality of electrical contacts arranged to be successively touched by said electrical contact as said wheel is rotated step by step for producing an electrical signal in accordance with a stepping rotary position of said wheel; and, locking means for disabling said wheel rotating means, said locking means including engaging means for each of said pair of pushing members and said engaging means causing engagement between said pushing members and said casing when said pushing members are in their non-actuating position so as to disable said corresponding actuating members by preventing free movement of said pushing members from their non-actuating position to their actuating position.

17. A digital switch according to claim 16 in which said engaging means causes engagement between said pushing members and said casing so that when said pushing members are in their erect actuating position they are prevented from being freely moved into their non-actuated position by said engagement.

* * * * *